US009997278B2

(12) United States Patent
Verhoeven et al.

(10) Patent No.: US 9,997,278 B2
(45) Date of Patent: Jun. 12, 2018

(54) NON-MAGNETIC STAINLESS STEEL WIRE AS AN ARMOURING WIRE FOR POWER CABLES

(71) Applicant: NV BEKAERT SA, Zwevegem (BE)

(72) Inventors: Flip Verhoeven, Aalter (BE); David Hejcman, Antwerp (BE); Geert Lagae, Harelbeke (BE); Peter Gogola, Trnava (SK)

(73) Assignee: NV BEKAERT SA, Zwevegem (BE)

( * ) Notice: Subject to any disclaimer, the term of this patent is extended or adjusted under 35 U.S.C. 154(b) by 420 days.

(21) Appl. No.: 14/375,752

(22) PCT Filed: Dec. 12, 2012

(86) PCT No.: PCT/EP2012/075242
§ 371 (c)(1),
(2) Date: Jul. 30, 2014

(87) PCT Pub. No.: WO2013/117270
PCT Pub. Date: Aug. 15, 2013

(65) Prior Publication Data

US 2015/0017473 A1 Jan. 15, 2015

(30) Foreign Application Priority Data

Feb. 6, 2012 (EP) ..... 12154046

(51) Int. Cl.

| | |
|---|---|
| ***H01B 7/22*** | (2006.01) |
| ***C23C 2/02*** | (2006.01) |
| ***C23C 2/36*** | (2006.01) |
| ***C23C 2/38*** | (2006.01) |
| ***C23C 28/02*** | (2006.01) |

(Continued)

(52) U.S. Cl.
CPC ..... *H01B 7/22* (2013.01); *C23C 2/02* (2013.01); *C23C 2/36* (2013.01); *C23C 2/38* (2013.01); *C23C 28/023* (2013.01); *H01B 7/14* (2013.01); *H01B 13/227* (2013.01); *Y10T 428/12792* (2015.01); *Y10T 428/12799* (2015.01)

(58) Field of Classification Search
CPC ..... H01B 7/20
USPC ..... 174/106 R, 130
See application file for complete search history.

(56) References Cited

U.S. PATENT DOCUMENTS 1,904,116 A * 4/1933 Baum ..... H01B 5/08 174/128.1
2,966,648 A * 12/1960 Morey ..... H05B 3/56 174/107

(Continued)

FOREIGN PATENT DOCUMENTS

CN 101950619 A 1/2011
CN 201796643 U 4/2011

(Continued)

*Primary Examiner* — William H Mayo, III
*Assistant Examiner* — Krystal Robinson
(74) *Attorney, Agent, or Firm* — Foley & Lardner LLP

(57) ABSTRACT

A non-magnetic stainless steel wire with an adherent corrosion resistant coating is disclosed. The surface of the non-magnetic stainless steel is pre-treated so as to be sufficiently free from oxides and form a good adhesion with the above corrosion resistant coating. The non-magnetic stainless steel wire is used as a armoring wire for a power cable for transmitting electrical power.

14 Claims, 1 Drawing Sheet

(51) Int. Cl.
*H01B 7/14* (2006.01)
*H01B 13/22* (2006.01)

(56) References Cited

U.S. PATENT DOCUMENTS

| | | | | | |
|---|---|---|---|---|---|
| 3,555,169 | A * | 1/1971 | Miller | H01B 11/00 | 174/106 R |
| 4,169,426 | A * | 10/1979 | Kornmann et al. | 118/67 | |
| 4,689,444 | A * | 8/1987 | Burgess | H01B 5/08 | 174/128.1 |
| 6,276,120 | B1 * | 8/2001 | Adriaensen | B66B 7/06 | 57/210 |
| 2003/0209003 | A1 * | 11/2003 | Verstraeten | D02G 3/12 | 57/212 |
| 2006/0108034 | A1 | 5/2006 | Frommann et al. | | |
| 2012/0024565 | A1 * | 2/2012 | Orini | H01B 7/14 | 174/106 R |
| 2012/0097419 | A1 * | 4/2012 | Varkey | H01B 7/046 | 174/106 R |
| 2015/0017473 | A1 * | 1/2015 | Verhoeven | C23C 2/02 | 428/659 |

FOREIGN PATENT DOCUMENTS

| | | | |
|---|---|---|---|
| EP | 2 371 984 | A1 | 10/2011 |
| JP | 4-221053 | A | 8/1992 |
| JP | 4-221098 | A | 8/1992 |
| WO | WO 2005/075697 | A1 | 8/2005 |

* cited by examiner

NON-MAGNETIC STAINLESS STEEL WIRE AS AN ARMOURING WIRE FOR POWER CABLES

TECHNICAL FIELD

The invention relates to a non-magnetic stainless steel wire and the use thereof, e.g. as armouring wire for a tri-phase submarine power cable for transmitting electrical power.

BACKGROUND ART

Electricity is an essential part of modern life. Electric-power transmission is the bulk transfer of electrical energy, from generating power plants to electrical substations located near demand centres. Transmission lines mostly use high-voltage three-phase alternating current (AC). Electricity is transmitted at high voltages (110 kV or above) to reduce the energy lost in long-distance transmission. Power is usually transmitted through overhead power lines. Underground power transmission has a significantly higher cost and greater operational limitations but is sometimes used in urban areas or sensitive locations. Most recently, submarine power cables provide the possibility to supply power to small islands or offshore production platforms without their own electricity production. On the other hand, submarine power cables also provide the possibility to bring ashore electricity that was produced offshore (wind, wave, sea currents . . . ) to the mainland.

These power cables are normally steel wire armoured cables. A typical construction of steel wire armoured cable 10 is shown in FIG. 1. Conductor 12 is normally made of plain stranded copper. Insulation 14, such as made of cross-linked polyethylene (XLPE), has good water resistance and excellent insulating properties. Insulation 14 in cables ensures that conductors and other metal substances do not come into contact with each other. Bedding 16, such as made of polyvinyl chloride (PVC), is used to provide a protective boundary between inner and outer layers of the cable. Armour 18, such as made of steel wires, provides mechanical protection, especially provide protection against external impact. In addition, armouring wires 18 can relieve the tension during installation, and thus prevent copper conductors from elongating. Possible sheath 19, such as made of black PVC, holds all components of the cable together and provides additional protection from external stresses.

Patent application CN101950619A discloses an armouring structure for a high voltage submarine cable. The armouring structure is a mixed armouring layer in an annular form and is made from round copper wires and non-magnetic stainless steel wires. The round copper wires and non-magnetic stainless steel wires are arranged in alternation. However, due to the application of two materials, the production process becomes complex. Moreover, the use of copper makes this armouring structure quite expensive.

Alternatively, it is possible to merely use steel wires to construct armouring structure of power cables. Since the application environment of these cables contains moisture, certain corrosion protection for these cables is desired and stainless steels are applied as armouring wires. However, when the application environment is very corrosive, especially for submarine cables because the cable (core) heats up and that the corrosion resistance in sea water of the traditional stainless steel alloys strongly degrades with raising temperature, the corrosion protection of the power cables becomes crucial. Therefore, stainless steel wires with galvanized layer as corrosion resistant layer are considered to be used as armouring wires in particular for submarine power cables.

However, through a conventional galvanizing process, the coated galvanized layer is usually not firmly adherent to the stainless steel wire. Thus, the galvanized layer is easily laminated and peels off from the armouring steel wire under external forces. Therefore, a failure of corrosion protection occurs and limits the life of the power cable.

DISCLOSURE OF INVENTION

It is a main object of the present invention to overcome the problems of the prior art.

It is another object of the present invention to produce a non-magnetic stainless steel wire having a good adhesion with the above corrosion resistant coating.

It is still another object of the present invention to apply this non-magnetic stainless steel wire with adherent corrosion resistant coating in an armouring structure of power cables.

It is a further object of the present invention to provide a non-magnetic steel wire armouring structure to minimize the magnetic loss of the power cables.

Stainless steel differs from carbon steel by the amount of chromium present. Unprotected carbon steel rusts readily when exposed to air and moisture. Stainless steels contain sufficient chromium (with a minimum of 10.5 wt %) to form a passive film of chromium-rich oxide, which prevents further surface corrosion and blocks corrosion from spreading into the metal's internal structure. A basic class of stainless steel has a 'ferritic' structure and is magnetic. It is formed from the addition of chromium and can be hardened through the addition of carbon (making them 'martensitic'). However, present invention is related to non-magnetic stainless steel, which is 'austenitic'. Non-magnetic stainless steel has a desired chromium content and additionally nickel, manganese, along with other alloying elements are also added. It is the addition of "austenite forming" elements (Ni, Mn, . . . ) which modify the microstructure of the steel and make it non-magnetic. Non-magnetic stainless steel also contains other components which give the austenitic stainless steel superior properties for different applications.

Although stainless steel has a corrosion protection due to the instantaneously formed chromium oxide, this is not sufficient for some applications in harsh environment, such as submarine application. Therefore, a corrosion resistant layer, in particular a galvanized layer, is applied on stainless steel wire to further strengthen its corrosion protection.

According to a first aspect of the present invention, there is provided a non-magnetic stainless steel wire, comprising a corrosion resistant coating on the surface thereof. The surface of the non-magnetic stainless steel is pre-treated so as to be sufficiently free from oxides and thus form a good adhesion with the above corrosion resistant coating.

It is found that chromium oxide, which contributes to the 'stainless' property of the stainless steel, is detrimental for adhesion with the above corrosion resistant coating. However, chromium oxide instantaneously forms on the surface of stainless steel as soon as the surface is exposed to air since stainless steel contains a minimum of 10.5 wt % chromium. Therefore, in conventional process, certain amount of chromium oxide presents on the surface of stainless steel wires before the corrosion resistant layer is coated. In the present invention, term 'sufficiently free from oxides' reflects that an additional and specific pre-treatment is taken to prevent the activated surface of stainless steel wires from oxygen contamination after the surface is activated, in particular after the oxide is removed, by pickling, plasma cleaning and/or reduction atmosphere and before the above corrosion resistant coating is formed. Because the occurrence of oxides, especially chromium oxide, is limited on the surface, the adhesion of above corrosion resistant coating to the stainless steel wire is good.

Preferably, said corrosion resistant coating is a hot dipped zinc or zinc alloy layer.

In the context of the present invention, the pre-treatment implemented on the non-magnetic stainless steel wires includes one or more of the following scenarios: the surface of the non-magnetic stainless steel wire is pre-treated by electroplating of nickel; the surface of the non-magnetic stainless steel wire is pre-treated by electroplating of zinc or zinc alloy; the non-magnetic stainless steel wire is pre-treated by being held in inert and/or reduction atmosphere before the corrosion resistant coating is formed thereon. All these possible pre-treatments aim to block the activated surface from air or oxygen contamination, and thus avoid the occurrence of oxides on the activated surface. Therefore, these pre-treatments assist the surface of the non-magnetic stainless steel wire to form a good adhesion with the later formed corrosion resistant coating.

JP4221098A and JP4221053A both disclose a production of galvanized stainless steel material. In contrast to the non-magnetic stainless steel wires of the present application, these two patents relate to a steel plate or strip and do not specify to a non-magnetic material.

A preferred non-magnetic stainless steel wire of present invention has a round diameter ranging between 1.0 mm to 10.0 mm.

According to a second aspect of the present invention, there is provided a process for a hot dip galvanization of a stainless steel wire. It comprises the following steps: degreasing the wire in a degreasing bath; rinsing the wire; activating the wire surface; transferring the wire to a hot dip zinc bath and/or zinc alloy bath under the protection of inert and/or reduction atmosphere; dipping the wire in the zinc bath and/or zinc alloy bath to form a zinc and/or zinc alloy coating thereon; and cooling the wire.

The wire surface activation includes any one or more of pickling, atmospheric reduction, and plasma cleaning. When the wire surface is activated by pickling, it further comprises a step of fluxing after pickling. Preferably, the stainless steel wire is protected by an inert and/or reduction atmosphere in the step of pickling and/or fluxing. When the wire surface is activated by atmospheric reduction, the wire is preferably heated to a temperature ranging between 400° C. to 900° C.

Herewith, the plasma cleaning includes vacuum and atmospheric plasma cleaning. In vacuum plasma cleaning, the wire is enclosed in a low pressure (vacuum) tube. Inside the tube or around the wire, ions are activated by the high voltage between the wire and the tube, such as any one or more of Ar+, $N_2$+, He+ and $H_2$+, as a plasma to remove the chromium oxide on the surface of the wire. An additional effect of the vacuum plasma cleaning provides a concomitant annealing on the steel wire. In atmospheric plasma cleaning, an ion gun is applied inside the tube where vacuum is not really needed. The activated ions are generated in the gun and imposed on the surface of the wire as a cleaning agent.

According to a third aspect of the present invention, there is provided a use of the non-magnetic stainless steel wire as an armouring wire for a power cable for transmitting electrical power.

Herewith, the power cables include high-voltage, medium-voltage as well as low-voltage cables. The common voltage levels used in medium to high voltage today, e.g. for in-field cabling of offshore wind farms, are 33 kV for in-field cabling and 150 kV for export cables. This may evolve towards 66 and 220 kV, respectively. The high-voltage power cables may also extend to 280, 320 or 380 kV if insulation technologies allow the construction. Since magnetic losses can also occur at low voltage levels, the non-magnetic armouring steel wires are also suitable for the low-voltage cables.

On the other hand, the power cables armoured with the non-magnetic stainless steel wires according to the invention can transmit electrical power having different frequencies. For instance, it may transmit the standard AC power transmission frequency, which is 50 Hz in Europe and 60 Hz in North and South America. Moreover, the power cable can also be applied in transmission systems that use 17 Hz, e.g. German railways, or still other frequencies.

A preferable power cable according to the invention is a tri-phase submarine power cable.

According to the present invention, the non-magnetic stainless steel wire is wound around at least part of the power cable.

Preferably, the power cable has at least an annular armouring layer made of the non-magnetic stainless steel wires.

The application of the non-magnetic stainless steel wires of the invention as armouring wires for submarine cables substantially prolongs the life time of the power cables because the corrosion resistant coating is firmly adherent to the armouring wires and provides sufficient corrosion protection. Simultaneously, the 'non-magnetic' property of the stainless steel wires according to the invention effectively reduces the energy loss of the power cables.

In three-phase power cables, the sum of the individual currents flowing through the three conductors is under ideal circumstances equal to zero. This means that no specific current return conductor is needed. If for one reason or another, such as asymmetric power production or consumption, the sum is not perfectly zero, the return current can perfectly flow through the conventional steel wire armouring and/or the water blocking barrier which are usually made of lead or lead alloy, and sometimes copper or aluminium.

On the other hand, even if the sum of the three phase currents is zero or close to zero, this does not necessarily apply to the magnetic field: seen from a large distance, such as 10 meter or more away from the cable, the magnetic fields of the three conductors do compensate each other, yielding a very low magnetic field radiation there. But as the armouring wire is normally applied quite close to the individual conductors, we have to take into account that the magnetic fields radiated by the three individual conductors are not fully compensating each other right there. This means that the fluctuating magnetic field strength in the armouring is quite high, which leads to important losses in the armouring: hysteresis losses and eddy current losses, whereby at 50 Hz hysteresis accounts for about 90% of the magnetic losses and eddy-currents for not more than 10%. At higher frequencies, eddy current losses gain importance with respect to hysteresis (at 400 Hz both components are more or less the same size, but 400 Hz is normally not used for power transmission). Non-magnetic armouring materials normally fully eliminate hysteresis losses and considerably reduce eddy-current losses, compared to carbon steel.

A typical (AC, 150 kV, three phase) 50 km long power cable consumes about 1.5% of the energy transported through it. Most of the energy is lost in the core conductors, because of their ohmic resistance (power loss=resistance× current$^2$). The magnetic losses are typically between 15 and 30% of the total cable losses and can be nearly 100% eliminated by the use of non-magnetic armouring wire, as the hysteresis effect explained above does not occur.

In a particular embodiment of a power cable according to the invention and from a general point of view, it is advantageous to combine both magnetic armouring wire and non-magnetic armouring wire. This combination may be done both in a serial set-up as in a parallel set-up.

Regarding the serial set-up, this means that along the length of the power cable, one part is comprising magnetic armouring wire and another part, different from and following the one part, is comprising non-magnetic armouring wire. The part with the non-magnetic armouring wire may be used for locations where it is difficult to cool the power cable, e.g. in harbours where the power cable can be buried deep. The part with the non-magnetic armouring wire may also be used in locations where the power cable has to transport the highest electrical powers, e.g. at junctions of various other power cables.

Relating to the parallel set-up, an armouring layer comprising both non-magnetic wires and magnetic wires already strongly reduces the magnetic losses in a cable. It may well be that this option is still more cost-effective than choosing a 100% amagnetic armouring, because of the cost implications of amagnetic wires. A preferable embodiment in this respect is combining zinc-coated non-magnetic stainless steel wires together with zinc-coated magnetic low-carbon steel wires. As both are zinc-coated one will not suffer particularly from the neighbourhood or adjacency of the other in the corrosive marine environment. An example of this embodiment provides an armouring layer where a non-magnetic stainless steel wire alternates with a magnetic wire.

A low-carbon steel wire has a steel composition where the carbon content ranges between 0.02 wt % and 0.20 wt %, the silicon content ranges between 0.05 wt % and 0.25 wt %, the chromium content is lower than 0.08 wt %, the copper content is lower than 0.25 wt %, the manganese content ranges between 0.10 wt % and 0.50 wt %, the molybdenum content is lower than 0.030 wt %, the nitrogen content is lower than 0.015 wt %, the nickel content is lower than 0.10 wt %, the phosphorus content is lower than 0.05 wt %, the sulphur content is lower than 0.05 wt %.

The presence of magnetic wires in the armouring layer of a power cable has the additional advantage of detectability as to the location of the power cable.

BRIEF DESCRIPTION OF FIGURES IN THE DRAWINGS

The invention will be better understood with reference to the detailed description when considered in conjunction with the non-limiting examples and the accompanying drawings, in which.

MODE(S) FOR CARRYING OUT THE INVENTION

Figure 1:
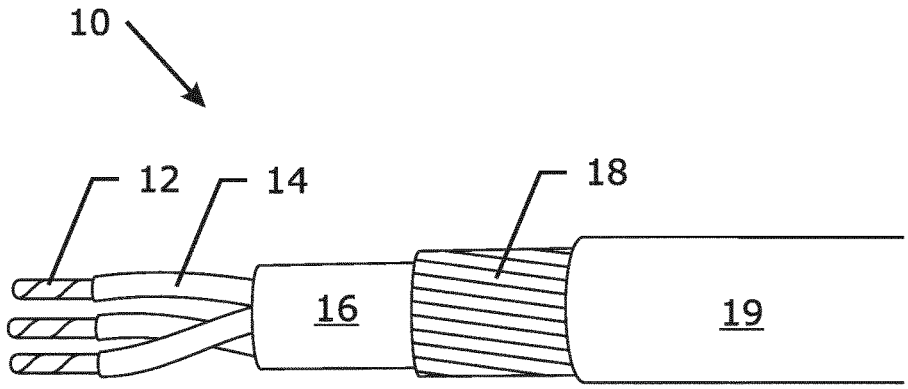
FIG. 1 is a high voltage power cable according to prior art.
Figure 2:
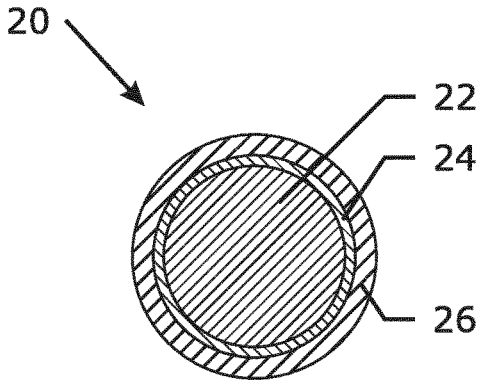
FIG. 2 is a cross-section of a non-magnetic stainless steel wire according to the first aspect of the invention.

FIG. 2 is a cross-section of a coated non-magnetic stainless steel wire 20. Non-magnetic stainless steel wire 22 is covered by a pre-coated adherent layer 24 and a corrosion resistant coating 26.

Example 1

A steel wire, ref. AISI 202, of a diameter of 1.9 mm is treated according to a first embodiment of the process.

The composition (in percentage by weight) of the wire rod is as follows: C less than 0.08; Si less than 0.75; Mn ranging from 6.6 to 8; P less than 0.045; S less than 0.015; N less than 0.15; Cr ranging from 15 to 17; Ni ranging from 3.5 to 5; Cu less than 2; and the balance is Fe.

The steel wire is processed continuously on one or more lines depending on the capabilities of the production site.

This steel wire is first degreased in an degreasing bath (containing phosphoric acid) at 30° C. to 80° C. for a few seconds. An ultrasonic generator is provided in the bath to assist the degreasing.

Alternatively, the steel wire may be first degreased in an alkaline degreasing bath (containing NaOH) at 30° C. to 80° C. for a few seconds. Electrical assistance is applied in the bath to assist the degreasing.

This is followed by a pickling step, wherein the steel wire is dipped in a pickling bath (containing 100-500 g/l sulphuric acid) at 20° C. to 30° C. to remove the instantaneously formed chromium oxide. This is followed by another successive pickling carried out by dipping the steel wire in a pickling bath (containing 100-500 g/l sulphuric acid) at 20° C. to 30° C. for a short time to further remove the chromium oxide on the surface of the steel wire. All pickling steps may be assisted by electric current to achieve sufficient activation.

After this second pickling step, the steel wire is immediately immersed in a electrolysis bath (containing 10-100 g/l zinc sulphate) at 20° C. to 40° C. for tens to hundreds of seconds. The steel wire is pre-electroplated with zinc and/or zinc alloy. To electrogalvanise, an electrical charge is applied on the steel wire, which attracts the zinc ions to bond to the surface. In current example, the electrogalvanized layer has a coat weight of 10-50 g/m$^2$. During this step the wire is running at a speed in the range of 20 to 100 m/min, preferably approximately at a speed of 30 m/min. Then the steel wire is rinsed in water and the excess of water is removed.

The electro-plated steel wire is further treated in a fluxing bath. The temperature of fluxing bath is maintained between 50° C. and 90° C., preferably at 70° C. Afterward, the excess of flux is removed. The steel wire is subsequently dipped in a galvanizing bath maintained at temperature of 400° C. to 500° C.

In present application, a coating formed on the surface of the stainless steel wire by galvanizing process is zinc and/or zinc alloy. The thickness of the galvanized coating is ranging from 20 g/m$^2$ to 600 g/m$^2$, e.g. ranging from 50 g/m$^2$ to 300 g/m$^2$. A zinc aluminum coating has a better overall corrosion resistance than zinc. In contrast with zinc, the zinc aluminum coating is more temperature resistant. Still in contrast with zinc, there is no flaking with the zinc aluminum alloy when exposed to high temperatures. A zinc aluminium coating may have an aluminium content ranging from 2 wt % to 23 wt %, e.g. ranging from 2 wt % to 12 wt %, or e.g. ranging from 5 wt % to 10 wt %. A preferable composition lies around the eutectoid position: aluminium about 5 wt %. The zinc alloy coating may further have a wetting agent such as lanthanum or cerium in an amount less than 0.1 wt % of the zinc alloy. The remainder of the coating is zinc and unavoidable impurities. Another preferable composition contains about 10 wt % aluminium. This increased amount of aluminium provides a better corrosion protection than the eutectoid composition with about 5 wt % of aluminium. Other elements such as silicon and magnesium may be added to the zinc aluminium coating. More preferably, with a view to optimizing the corrosion resistance, a particular good alloy comprises 2 wt % to 10 wt % aluminium and 0.2 wt % to 3.0 wt % magnesium, the remainder being zinc.

After hot-dip galvanising tie- or jet-wiping can be used to control the coating thickness. Then the wire is cooled down in air or preferably by the assistance of water. A continuous, uniform, void-free coating is formed. Several hot-dip galvanizing trials after a pre-electrogalvanizing and with different final coating thickness are summarized in table 1.

TABLE 1

Hot-dip galvanizing trials after a pre-electrogalvanizing.

| Sample | Speed [m/min] | Coat weight [g/m$^2$] |
|---|---|---|
| 1 | 80 | 21 |
| 2 | 120 | 265 |
| 3 | 80 | 228 |
| 4 | 40 | 217 |

Example 2

A steel wire, ref. AISI 202, of a diameter of 1.9 mm is treated according to a second embodiment of the process.

This steel wire is first degreased in an acid degreasing bath with the assistance of an ultrasonic generator or degreased in an alkaline degreasing bath with electrical assistance. The steel wire is continued with a pickling step, wherein the steel wire is dipped in a pickling bath (containing 100-500 g/l sulphuric acid) at 20° C. to 30° C. for a few seconds to remove the instantaneously formed chromium oxide. This is followed by another successive pickling carried out by dipping the steel wire in a pickling bath (containing 100-500 g/l sulphuric acid) at 20° C. to 30° C. for a very short time to further and sufficiently remove the chromium oxide on the surface of the steel wire.

After the second pickling step, the steel wire immediately flash coated by nickel sulfamate solution (containing 50-100 g/l) at 20° C. to 60° C. Then the steel wire is dipped in electrolysis bath (containing 50-100 g/l nickel sulfamate) at 20° C. to 60° C. for several minutes. To electroplate nickel, an electrical charge is applied on the steel wire, which attracts the nickel ions to bond to the surface. In this example, the electroplated nickel layer has a coat weight of 20-60 g/m$^2$. During this step the wire is running at a speed in the range of 20 to 100 m/min, preferably approximately at a speed of 30 m/min. Afterwards, the steel wire is rinsed in water and the excess of water is removed.

The steel wire with a pre-electroplated nickel coating on the surface is further treated in for example a zinc and ammonium chloride fluxing bath and dipped in a galvanizing bath, similar to example 1. After tie- or jet-wiping and cooling, a continuous, uniform, void-free coating was formed on the surface of the steel wire. Several hot-dip galvanizing trials after a pre-electroplated nickel coating and with different final coating thickness are summarized in table 2.

TABLE 2

Hot-dip galvanizing trials after a pre-electroplated nickel coating.

| Sample | Speed [m/min] | Coat weight [g/m$^2$] |
|---|---|---|
| 1 | 80 | 42 |
| 2 | 40 | 151 |
| 3 | 80 | 217 |

Example 3

A steel wire, ref. AISI 202, of a diameter of 1.9 mm, 6 mm, 7 mm and 8 mm is respectively treated according to a third embodiment of the process.

The steel wire is first degreased and then followed by pickling in acid solution. These processes are similar as in examples 1 and 2.

After the pickling process, the steel wire is rinsed in a flowing water rinsing bath.

In this example, after the excess of water is removed, the wires are further transferred under the protection of the tube filled with a heated reduction gas or gas mixture of argon, nitrogen and/or hydrogen to the galvanizing bath. Preferably, the wires are heated to 400° C. to 900° C. in the tube before the galvanizing bath.

The post steps in this example are similar to the steps illustrated in the above examples 1 and 2.

As a comparison, galvanizing trials are also performed through a conventional process, i.e. the steel wires are not pre-electroplated or there is no inert atmosphere protection during galvanizing process. Wrapping tests are performed on the final products to test the adhesion of coatings with steel wires. Steel wires coated with a pre-treatment step as in above illustrated examples show a very good surface quality: there is no micro-cracks and no delamination. While steel wires, which are not pre-electroplated or there is no inert atmosphere protection during galvanizing process, present a bad surface quality and some coatings are delaminated or peel off.

As a precaution, although steel wires, ref. AISI 202, of a diameter of 1.9, 6, 7 and 8 mm are used herewith as a half-product in the examples, other grade steel wire or steel wire with larger/smaller diameter can also be applied in the invention. It should be noted that a further wire drawing after galvanizing may be applied depending on the application if improvement of the tensile strength of the coated steel wires is desired.

Figure 3:
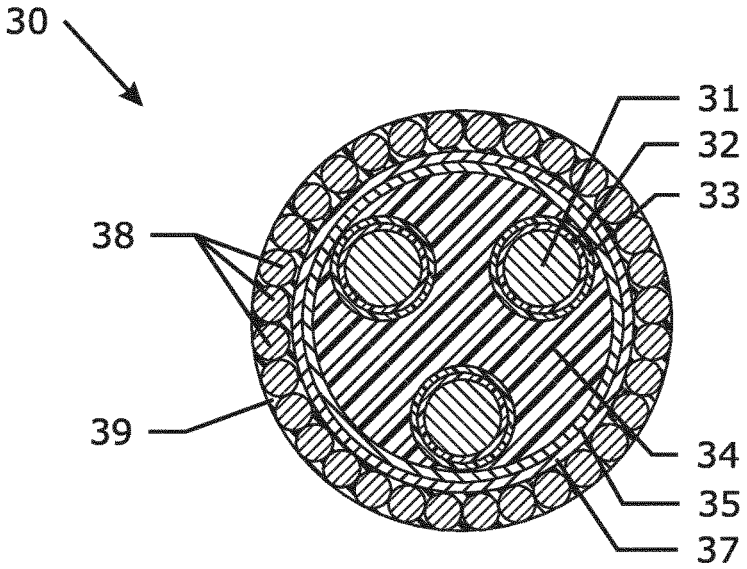
FIG. 3 is a cross-section of a tri-phase power cable having armouring wires.

FIG. 3 represents a cross-section of a tri-phase submarine power cable armoured with the non-magnetic stainless steel wires of present invention.

The tri-phase submarine power cable 30 is shown in the illustration. It includes a compact stranded, bare copper conductor 31, followed by a semi-conducting conductor shield 32. An insulation shield 33 is applied to ensure that the conductor do not contact with each other. The insulated conductors are cabled together with fillers 34 by a binder tape, followed by a lead-alloy sheath 35. Due to the severe environmental demands placed on submarine cables, the lead-alloy sheath 35 is often needed because of its compressibility, flexibility and resistance to moisture and corrosion. The sheath 35 is usually covered by an outer layer 37 comprising a polyethylene (PE) or polyvinyl chloride (PVC)

jacket. This construction is armoured by steel wire armouring layer 38. The steel wires used herein are according to the invention, i.e. they are non-magnetic stainless steel wires with an adherent galvanized layer for strong corrosion protection. An outer sheath 39, such as made of PVC or cross-linked polyethylene (XLPE) or a combination of PVC and XLPE layers, is preferably applied outside the armouring layer 38.

LIST OF REFERENCE NUMBERS

10 steel wire armoured cable
12 conductor
14 insulation
16 bedding
18 armour
19 sheath
20 coated non-magnetic stainless steel wire
22 non-magnetic stainless steel wire
24 pre-coated adherent layer
26 corrosion resistant coating
30 power cable
31 copper conductor
32 semi-conducting conductor shield
33 insulation shield
34 fillers
35 lead-alloy sheath
37 outer layer
38 steel wire armouring layer
39 outer sheath

The invention claimed is:

1. A power cable for transmitting electrical power, comprising:

an armouring layer comprising non-magnetic stainless steel wire and magnetic low-carbon steel wire, said non-magnetic stainless steel wire comprising a corrosion resistant coating on the surface of the non-magnetic stainless steel, wherein said surface is pre-treated, the pre-treated surface being sufficiently free from oxides and adhering to said corrosion resistant coating, said corrosion resistant coating is zinc and/or zinc alloy, and said corrosion resistant coating is present in an amount of 20 $g/m^2$ to 600 $g/m^2$, and said magnetic low-carbon steel wire comprising a corrosion resistant coating.

2. A power cable for transmitting electrical power as in claim 1, wherein said corrosion resistant coating on the surface of the non-magnetic stainless steel is a hot dipped zinc and/or zinc alloy coating.

3. A power cable for transmitting electrical power as in claim 1, wherein an intermediate layer of electroplated nickel is present between the non-magnetic stainless steel wire and said corrosion resistant coating on the surface of the non-magnetic stainless steel.

4. A power cable for transmitting electrical power as in claim 1, wherein said surface of the non-magnetic stainless steel wire is obtainable by a pre-treatment of electroplating with zinc and/or zinc alloy.

5. A power cable for transmitting electrical power as in claim 1, wherein said surface of the non-magnetic stainless steel is obtainable by a pre-treatment of being held in inert and/or reduction atmosphere before the corrosion resistant coating is formed thereon.

6. A power cable for transmitting electrical power as in claim 1, wherein said non-magnetic stainless steel wire has a round diameter ranging between 1.0 mm to 10.0 mm.

7. A power cable for transmitting electrical power according to claim 1, wherein the power cable is a tri-phase submarine power cable.

8. A power cable for transmitting electrical power according to claim 1, wherein said power cable is a high voltage cable of more than 110 kV.

9. A power cable for transmitting electrical power according to claim 1, wherein said non-magnetic stainless steel wire is wound around at least part of said power cable.

10. A power cable for transmitting electrical power according to claim 1, wherein said armouring layer is an annular armouring layer.

11. A power cable for transmitting electrical power according to claim 1, wherein said non-magnetic stainless steel wire and said magnetic low-carbon steel wire are arranged parallel to each other in the armouring layer.

12. A power cable for transmitting electrical power according to claim 1, wherein said non-magnetic stainless steel wire and said magnetic low-carbon steel wire alternate in the armouring layer.

13. A power cable for transmitting electrical power according to claim 1, wherein said non-magnetic stainless steel wire and said magnetic low-carbon steel wire are interspersed in the armouring layer.

14. A power cable for transmitting electrical power according to claim 1, wherein said magnetic low-carbon steel wire renders the location of the power cable detectable.

* * * * *